US011964787B2

(12) United States Patent
Moullard et al.

(10) Patent No.: US 11,964,787 B2
(45) Date of Patent: Apr. 23, 2024

(54) DEVICE FOR THE MECHANICAL HANDLING OF A FLEXIBLE BAG PLACED IN A HOLDER, AND LOGISTICAL PARCEL SORTING INSTALLATION COMPRISING SUCH A DEVICE

(71) Applicant: SOLYSTIC, Bagneux (FR)

(72) Inventors: Eric Moullard, Guilherand-Granges (FR); Damien Hughes, Upie (FR); Lionel Faivre, Valence (FR)

(73) Assignee: SOLYSTIC, Bagneux (FR)

( * ) Notice: Subject to any disclaimer, the term of this patent is extended or adjusted under 35 U.S.C. 154(b) by 0 days.

(21) Appl. No.: 18/272,664

(22) PCT Filed: Dec. 8, 2021

(86) PCT No.: PCT/FR2021/052233
§ 371 (c)(1),
(2) Date: Jul. 17, 2023

(87) PCT Pub. No.: WO2022/171933
PCT Pub. Date: Aug. 18, 2022

(65) Prior Publication Data

US 2024/0083613 A1 Mar. 14, 2024

(30) Foreign Application Priority Data

Feb. 9, 2021 (FR) ..... 2101215

(51) Int. Cl.
*B65B 43/26* (2006.01)
*B65B 67/12* (2006.01)

(52) U.S. Cl.
CPC ..... *B65B 43/26* (2013.01); *B65B 67/12* (2013.01)

(58) Field of Classification Search
CPC ..... B65B 43/26; B65B 67/12
(Continued)

(56) References Cited

U.S. PATENT DOCUMENTS 2,952,954 A * 9/1960 Perrin ..... B65B 43/28 53/459
3,333,496 A * 8/1967 Fox ..... B65B 43/26 53/384.1

(Continued)

FOREIGN PATENT DOCUMENTS

CN 206624063 U 11/2017
DE 19722067 A1 * 12/1998 ..... B65B 51/06

(Continued)

OTHER PUBLICATIONS

French Search Report dated Oct. 29, 2021 issued by INPI from corresponding Application No. FR 2101215, 8 pages.

(Continued)

*Primary Examiner* — Stephen F. Gerrity
(74) *Attorney, Agent, or Firm* — Ware, Fressola, Maguire & Barber LLP

(57) ABSTRACT

A device (5) is provided for the mechanical handling of a flexible bag (6) placed in a holder (7), the bag having a mouth with at least one flap (6*a*) that can close or open the mouth of the bag. The device comprises a brush wheel (8) that is mounted in rotation about a shaft (9), the brush wheel comprising fins (10) each consisting of a curved flexible portion (11) which extends from the shaft, and a straight end portion (12) which extends in continuation of the curved portion, the set of straight portions substantially forming a rim, and the brush wheel being arranged in such a way that, when it is rotated close to the mouth of the bag, centrifugal force straightens the curved portions, thus increasing the radius of the rim in order to allow the straight portions to rub against the flap of the bag.

13 Claims, 3 Drawing Sheets

(58) Field of Classification Search
USPC ..... 53/459, 384.1
See application file for complete search history.

(56) References Cited

U.S. PATENT DOCUMENTS

| | | | | | |
|---|---|---|---|---|---|
| 4,157,825 | A * | 6/1979 | Ellenberger et al. | .... | B65H 3/06 271/22 |
| 5,056,300 | A * | 10/1991 | Suzuki et al. | ..... | B65B 43/26 53/384.1 |
| 5,180,155 | A * | 1/1993 | Asai | ..... | B65H 3/02 271/21 |
| 2005/0280833 | A1* | 12/2005 | Dian et al. | ..... | B65H 43/08 356/630 |
| 2010/0182420 | A1* | 7/2010 | Mitte et al. | ..... | G06V 10/141 348/86 |
| 2015/0291296 | A1 | 10/2015 | Lorger et al. | | |
| 2018/0333750 | A1 | 11/2018 | Miette et al. | | |

FOREIGN PATENT DOCUMENTS

| | | | | | |
|---|---|---|---|---|---|
| EP | 0028119 | A1 * | 5/1981 | ..... | B65B 43/30 |
| FR | 3041550 | A1 | 3/2017 | | |
| JP | H07100970 | A | 4/1995 | | |
| WO | WO-2007105970 | A1 * | 9/2007 | ..... | B65B 43/28 |

OTHER PUBLICATIONS

International Search Report, Application No. PCT/FR2021/052233, mailed May 5, 2022, 9 pages.

* cited by examiner

DEVICE FOR THE MECHANICAL HANDLING OF A FLEXIBLE BAG PLACED IN A HOLDER, AND LOGISTICAL PARCEL SORTING INSTALLATION COMPRISING SUCH A DEVICE

TECHNICAL FIELD

The field of the invention is that of handling flexible bags intended for transporting objects such as parcels.

The invention relates to a device for the mechanical handling of a flexible bag placed in a holder.

The invention relates more particularly to a logistical parcel sorting installation comprising such a device.

PRIOR ART

Logistical parcel sorting installations generally use flexible bags for transporting parcels.

The bags are installed in holders, such as carriages, with the mouth open toward the top so as to allow the parcels to fall into the bags by gravity. Each bag also comprises flaps capable of being folded onto the side walls of the carriage in order to stabilize the bag in the carriage and to keep the mouth of the bag open during the loading of the parcels.

Once the parcels are loaded, the flaps of the bag are folded toward the inside of the carriage in order to facilitate the closing of the bag by a zipper.

The holder is then taken to a routing point in order to allow the discharge of the bag loaded with a parcel and the placement of a new empty flexible bag in the carriage.

The operation of closing and opening the bag, and more particularly the folding of the flaps of the bag, is currently carried out manually by an operator.

However, if the bag is flexible to facilitate the loading and the storing of the parcels, the flaps are heavy and difficult to fold for the operator.

The operation consisting of folding the flaps of the bags is therefore time-consuming for the operators and not in compliance with elementary rules of ergonomics.

There are also mechanical handling devices for a bag with a flap, such as the device disclosed in document US 2015/0291296, which also do not make it possible to address the above-mentioned problems.

SUMMARY OF THE INVENTION

The present application thus aims to solve the above-mentioned problems and, in this respect, relates to a device for the mechanical handling of a flexible bag comprising a holder in which the bag is placed, the bag having a mouth with at least one flap that can close or open the mouth of the bag, characterized in that it comprises a brush wheel that is mounted in rotation about a shaft, the brush wheel comprising fins each consisting of a curved flexible portion which extends from the shaft, and a straight end portion which extends in continuation of the curved portion, the set of straight portions substantially forming a rim, and in that the brush wheel is arranged in such a way that, when it is rotated close to the mouth of the bag, centrifugal force straightens the curved portions, thus increasing the radius of the rim in order to allow the straight portions to rub against the flap of the bag.

The basic idea of the device is to use the friction of the adhesive contact surface of the brush wheel in order to fold the flap toward the inside or the outside of the holder. More particularly, the idea consists in allowing or preventing the friction of the brush wheel on the flap of the bag by varying the radius of its rim.

Thus, when the brush wheel is stopped, the bag and its holder are not in contact with the brush wheel.

Conversely, when the brush wheel is rotating, the increase in the radius of the rim allows the brush wheel to rub against the flap of the bag in order to fold it toward the inside or the outside of the holder.

By virtue of this arrangement, the rotation of the brush wheel coordinated with the to-and-fro movement of the holder under the wheel makes it possible to specifically fold the flaps of the bag in order to open or close the bag.

The device according to the present application may also have the following features:

- the curved portions extend tangentially relative to the shaft;
- the curved portions are made of polyurethane with a hardness coefficient of between 30 sh and 50 sh;

The present application also extends to a logistical parcel sorting installation comprising a device according to the present application designed for the handling of flexible bags for transporting parcels placed in holders of the mobile sorting carriage type moved automatically by shuttle robots.

Each shuttle robot may be designed to move a bag transversely with respect to the shaft so that the brush wheel rubs against a flap of the bag in order to fold it toward the outside of the holder and to assist with opening the bag.

Each shuttle robot may also be designed to move a bag and its holder longitudinally with respect to the shaft so that the brush wheel rubs against a flap of the bag in order to fold it toward the inside of the holder and to assist with closing the bag.

BRIEF DESCRIPTION OF THE DRAWINGS

The present invention will be better understood and other advantages will become apparent on reading the detailed description of the invention done by way of non-limiting example and illustrated by the appended drawings, in which.

DETAILED DESCRIPTION

Figure 1:
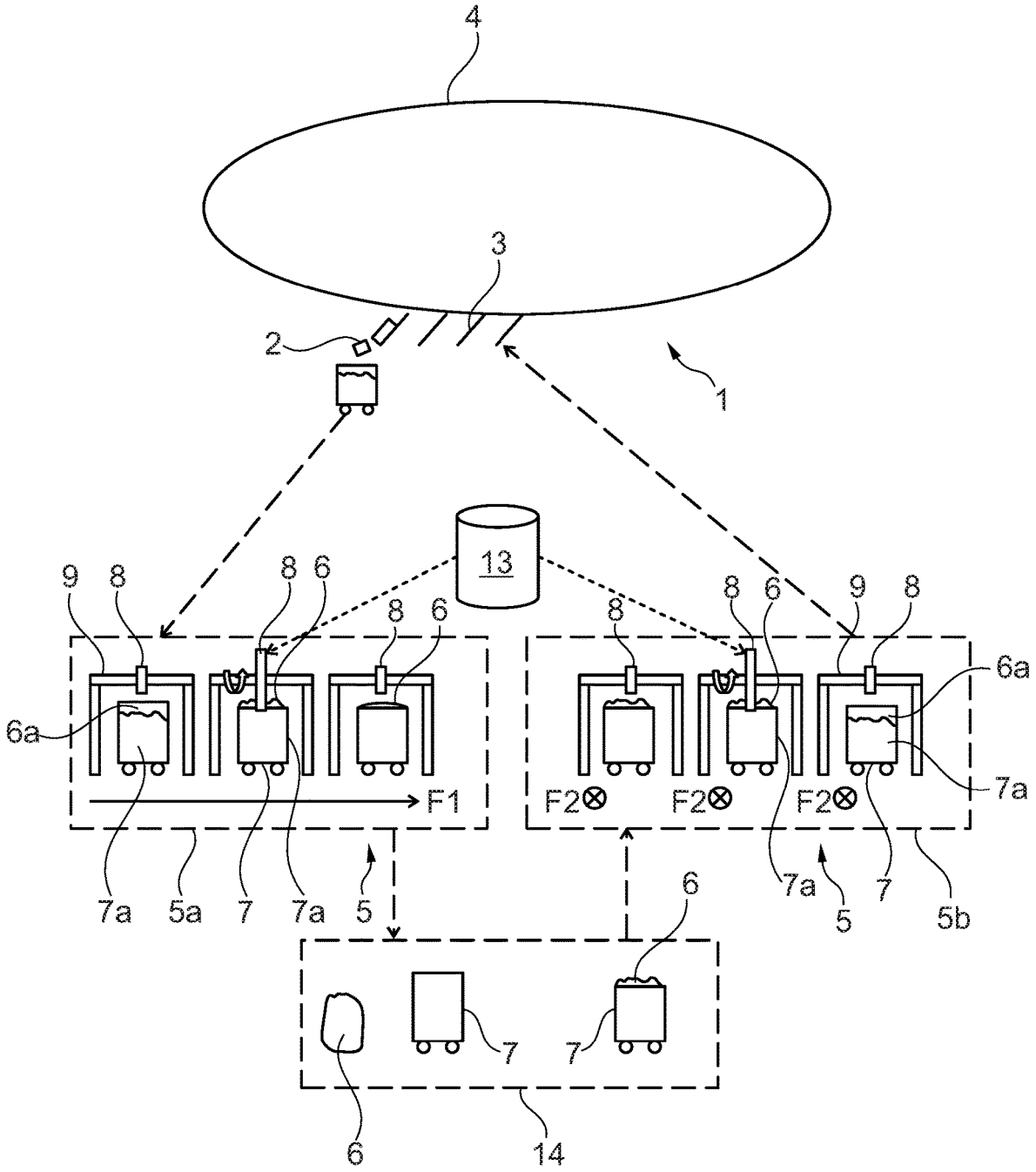
FIG. 1 is a schematic depiction of a logistical parcel sorting installation according to the invention.

FIG. 1 depicts a logistical installation 1 for sorting parcels 2 according to the present application comprising sorting outputs 3 distributed along a sorting conveyor 4 capable of sorting parcels 2 in bags 6 for transporting parcels. The logistical installation 1 according to the present application also comprises a device 5 for the mechanical handling of flexible bags 6, herein bags for transporting parcels, placed in mobile holders 7 of the sorting carriage type moved automatically by shuttle robots.

The device 5 according to the present application is designed to treat bags 6 arranged in their carriage 7 with the mouth herein oriented upward and with at least one flap 6*a* capable of being folded toward the outside or the inside of the carriage 7, respectively, for opening or closing the bag 6.

The sorting carriage 7 herein comprises a bottom, four side walls 7*a* and an opening on the top.

Each bag 6 therefore comprises at least one flap 6*a* intended to be folded onto a side wall 7*a* of the carriage 7.

Figure 2A:
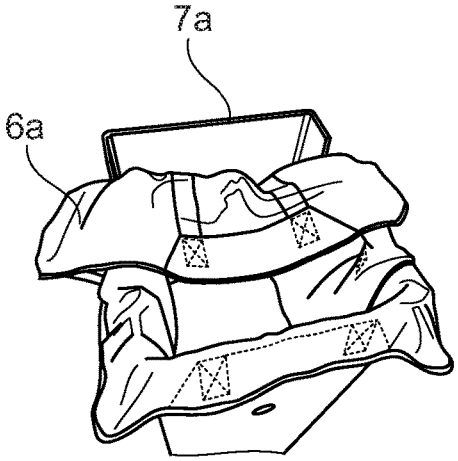
FIGS. 2*a* through 2*f* show a schematic depiction of a mechanical device for the handling of a flexible bag according to the invention in a kinetic assembly to assist with opening a flexible bag.
Figure 2D:
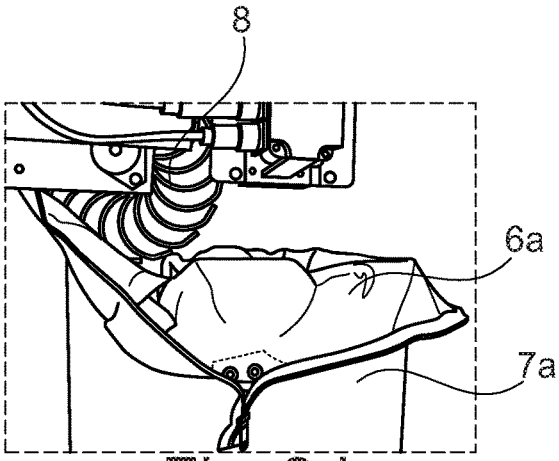
Figure 2B:
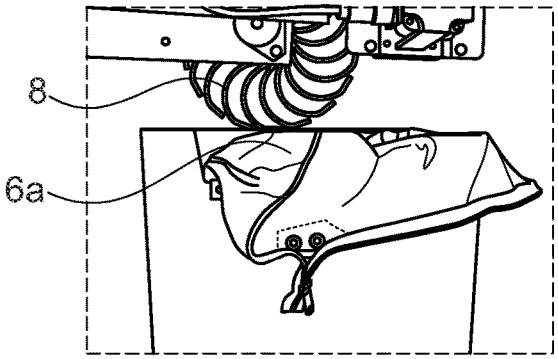
Figure 2E:
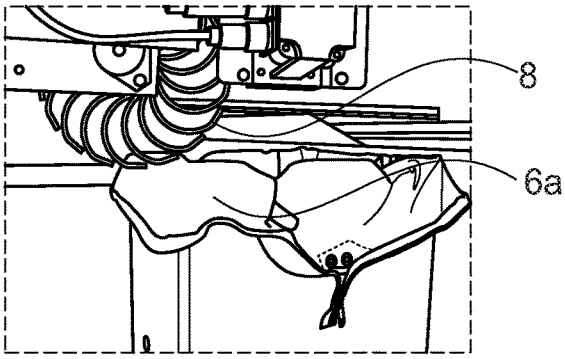
Figure 2C:
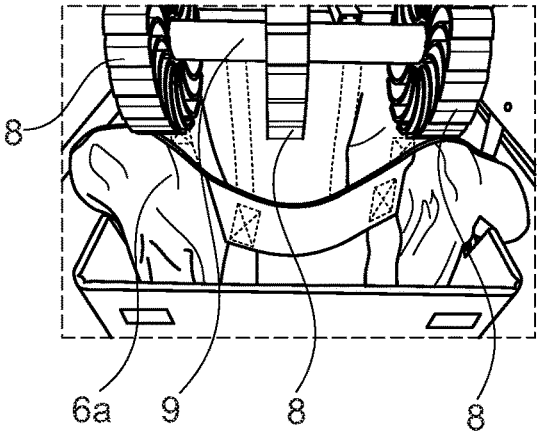
Figure 2F:
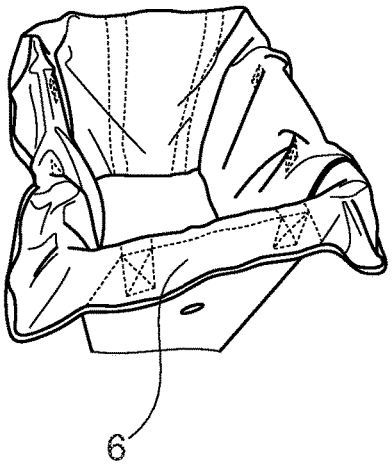

The device 5 according to the present application more particularly comprises at least one brush wheel 8, visible in FIG. 2*c*, mounted in rotation about a shaft 9 capable of rubbing against the flap 6*a* of the bag 6.

The shaft 9 serves as a holder for the brush wheel 8 and is presented herein by way of example in the form of a horizontal bar.

The brush wheel 8 serves herein as a gripping member capable of raising or lowering the flap 6*a* of the bag 6 on one side or the other of a side wall 7*a* of the carriage 7.

For this purpose, the brush wheel 8 has an adhesive contact surface capable of adhering to the flap 6*a* during the rubbing, with for example a friction coefficient of about 0.5.

Figure 4A:
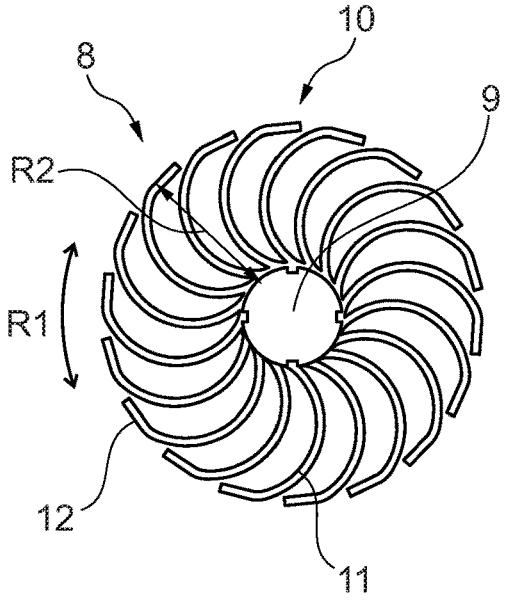
FIG. 4*a* is a schematic depiction of a brush wheel according to the invention when it is stopped.
Figure 4B:
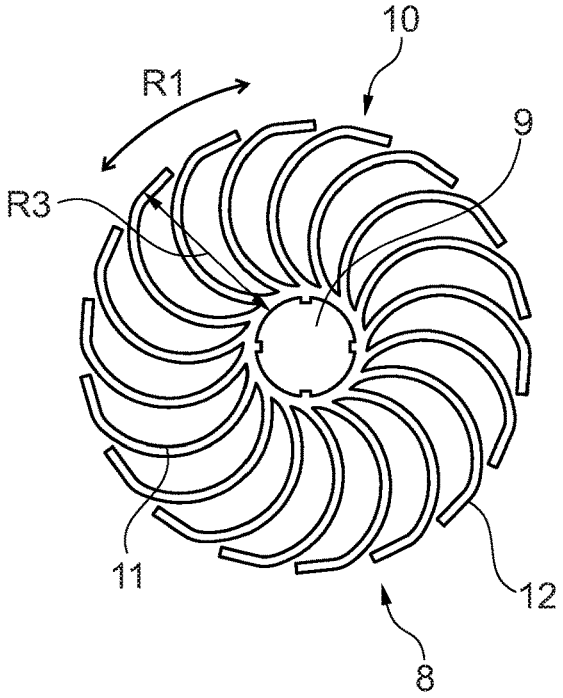
FIG. 4*b* is a schematic depiction of a brush wheel when it is rotated.

More particularly, the brush wheel 8 comprises fins 10, as shown in FIGS. 4*a* and 4*b*.

Each fin 10 according to the present application comprises a curved flexible portion 11 extending from the shaft 9 and a straight end portion 12 which extends the curved portion 11.

By way of example, the fins 10 of the brush wheel 8 will have a width of about 50 mm so as to reach a friction surface of about 10 $cm^2$ with the bag 6, surface which is large enough to allow the flap 6*a* to be folded while avoiding frictional contact with other adjacent flaps.

By virtue of the arrangement of the fins 10, the straight end portions 12 substantially form a rim and the curved portions 11 substantially form the spokes of the wheel.

Thus, when the brush wheel 8 is rotating, centrifugal force straightens the curved portions 11 in order to increase the radius of the rim along a radius length R3, as shown in FIG. 4*b*.

Conversely, when the brush wheel 8 is stopped, the curved portions 11 are fully bent for a radius length R2 less than the radius length R3, as can be seen in FIG. 4*a*.

Thus, the greater the length of the radius, the more the shaft may be offset heightwise in order to move the brush wheel 8 away from the carriage 7.

The risk of the brush wheel 8 rubbing against the bag 6 when the brush wheel 8 is stopped can therefore be easily avoided.

It will also be understood that the length of the radius of the rim depends not only on the length of the curved portions 11 of the fins 10 but also on the speed of rotation of the brush wheel 8.

In one particular embodiment, the curved portions 11 according to the present application may be made of polyurethane with a hardness coefficient of 40 sh (Shore hardness) and extend over a given length such that the diameter of the brush wheel is about 250 mm when it is stopped and about 280 mm when it is rotating at maximum speed.

The curved portions 11 may also extend tangentially with respect to the shaft 9, that is to say, perpendicular with respect to the spokes, in order to minimize the radius of the rim when the brush wheel 8 is stopped.

The device 5 according to the present application may also be equipped with a control/command unit 13 parameterized to control the movement of the carriage 7 and to control the rotation of the brush wheel 8 in a forward and backward direction of rotation.

A kinetic assembly for opening a flap 6*a* of the bag 6 positioned inside the carriage 7 is depicted in FIGS. 2*a* through 2*f*, and in FIG. 1 in the space 5*b* of the logistical installation 1 dedicated to opening the bag 6. In this kinetic assembly, the control/command unit 13 is parameterized both to automatically control the movement of a shuttle robot at constant speed and thus move the carriage 7 transversely to the shaft 9 along the arrow F2, and to control the rotation of the brush wheel 8 as soon as the brush wheel 8 is positioned vertically in line with the center of the mouth of the bag 6 and until it comes in line with the side wall 7*a* of the corresponding carriage 7, as can be seen in FIG. 2*c*.

The brush wheel 8 is rotated herein in a direction of rotation opposite to the orientation of the fins 10, herein the forward direction of rotation.

This has the effect of raising the flap 6*a* of the bag 6 with no risk of a fin 10 catching with the bag 6.

As soon as the flap 6*a* is raised above one of the side walls 7*a* of the carriage 7, the control/command unit 13 is parameterized to control the rotation of the brush wheel 8 in the other direction of rotation, herein the backward direction of rotation, in order to lower the flap 6*a* of the bag 6 toward the outside of the carriage 7, as shown in FIG. 2*d*.

To assist with the opening of flaps 6*a* of the bag 6, it is also possible to provide two side brush wheels 8 and a central brush wheel 8 on the shaft 9, as shown in FIG. 2*c*.

The two side brush wheels 8 are arranged to be located in line with the side walls 7*a* on the side of the carriage 7 during its transverse movement and the central brush wheel 8 is arranged so as to be located in line with the front side wall 7*a* in the direction of movement of the carriage 7.

The bags 6 loaded with parcels with the flaps 6*a* folded toward the inside of the carriage 7 are then closed with the zipper and next transported to the conveying zone 14, as shown in FIG. 1.

The bags 6 are then unloaded from the carriages 7 in order to be replaced by empty bags 6*a* which are in turn transported toward a space 5*a* of the logistical installation 1 dedicated to closing the bags 6.

Figure 3:
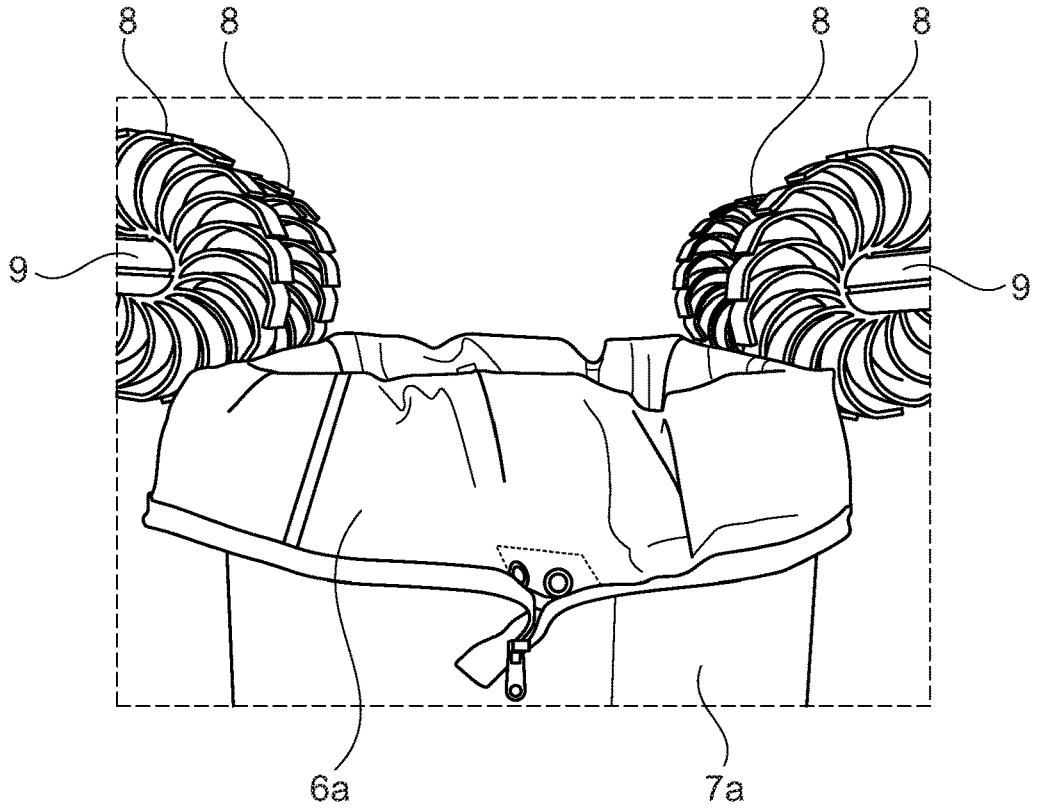
FIG. 3 is a schematic depiction of a mechanical device for the handling of a flexible bag according to the invention to assist with closing the bag.

One example of closing a flap 6*a* of a bag 6 positioned inside a carriage 7 is depicted in FIG. 3 and in FIG. 1 in the space 5*a* of the logistical installation 1 dedicated to closing the bag 6.

The control/command unit 13 is parameterized both to automatically control the movement of a shuttle robot at constant speed and thus move the carriage 7 longitudinally to the shaft 9 along the arrow F1, and to control the rotation of the brush wheel 8 as soon as the brush wheel 8 is positioned in line with the side wall 7*a* on the side of the carriage 7 on which the flap 6 is folded.

Two parallel shafts 9, depicted in FIG. 3, each provided with several brush wheels 8, may be provided on each side of the carriage 7 in order to simultaneously fold the flaps 6*a* of the bag 6 on two opposite side walls 7*a* of the carriage 7.

What is claimed is:

1. A device for the mechanical handling of a flexible bag comprising a holder in which the bag is placed, the bag having a mouth with at least one flap that can close or open the mouth of the bag, wherein the device further comprises a brush wheel that is mounted in rotation about a shaft, the brush wheel comprising fins each consisting of a curved flexible portion which extends from the shaft, and a straight end portion which extends in continuation of the curved portion, the set of straight portions substantially forming a rim, and the brush wheel being arranged in such a way that, when the brush wheel is rotated close to the mouth of the bag, centrifugal force straightens the curved portions, thus increasing the radius of the rim in order to allow the straight portions to rub against the flap of the bag.

2. The device according to claim 1, wherein the curved portions extend tangentially with respect to said shaft.

3. The device according to claim 2, wherein the curved portions are made of polyurethane with a hardness coefficient of between 30 sh and 50 sh.

4. A logistical parcel sorting installation comprising the device according to claim 2, and being configured to handle flexible bags for transporting parcels placed in holders of a mobile sorting carriage type moved automatically by shuttle robots.

5. The logistical parcel sorting installation according to claim 4, wherein each shuttle robot is configured to move a bag and its holder transversely to said shaft so that the brush wheel rubs against a flap of the bag in order to fold the flap of the bag toward the outside of the holder and to assist with opening the bag.

6. The logistical parcel sorting installation according to claim 4, wherein each shuttle robot is configured to move a bag and its holder longitudinally with respect to said shaft so that the brush wheel rubs against a flap of the bag in order to fold the flap of the bag toward the inside of the holder and to assist with closing the bag.

7. The device according to claim 1, wherein the curved portions are made of polyurethane with a hardness coefficient of between 30 sh and 50 sh.

8. A logistical parcel sorting installation comprising the device according to claim 7, and being configured to handle flexible bags for transporting parcels placed in holders of a mobile sorting carriage type moved automatically by shuttle robots.

9. The logistical parcel sorting installation according to claim 8, wherein each shuttle robot is configured to move a bag and its holder transversely to said shaft so that the brush wheel rubs against a flap of the bag in order to fold the flap of the bag toward the outside of the holder and to assist with opening the bag.

10. The logistical parcel sorting installation according to claim 8, wherein each shuttle robot is configured to move a bag and its holder longitudinally with respect to said shaft so that the brush wheel rubs against a flap of the bag in order to fold the flap of the bag toward the inside of the holder and to assist with closing the bag.

11. A logistical parcel sorting installation, comprising the device according to claim 1, and being configured to handle flexible bags for transporting parcels placed in holders of a mobile sorting carriage type moved automatically by shuttle robots.

12. The logistical parcel sorting installation according to claim 11, wherein each shuttle robot is configured to move a bag and its holder transversely to said shaft so that the brush wheel rubs against a flap of the bag in order to fold the flap of the bag toward the outside of the holder and to assist with opening the bag.

13. The logistical parcel sorting installation according to claim 11, wherein each shuttle robot is configured to move a bag and its holder longitudinally with respect to said shaft so that the brush wheel rubs against a flap of the bag in order to fold the flap of the bag toward the inside of the holder and to assist with closing the bag.

* * * * *